United States Patent [19]

Bushnell, Jr.

[11] Patent Number: 4,458,785

[45] Date of Patent: Jul. 10, 1984

[54] LIFT

[76] Inventor: Sherman W. Bushnell, Jr., 1214 E. Hamlin St., Seattle, Wash. 98102

[21] Appl. No.: 436,304

[22] Filed: Oct. 25, 1982

[51] Int. Cl.[3] ..... B66B 9/20

[52] U.S. Cl. ..... 187/9 E; 182/145; 182/63

[58] Field of Search ..... 182/148, 63, 112, 208, 182/141, 145, 146, 103, 104; 187/9 E, 11, 94; 52/121

[56] References Cited

U.S. PATENT DOCUMENTS

| | | | |
|---|---|---|---|
| 506,709 | 10/1893 | Minot | 182/208 |
| 2,883,003 | 4/1959 | Arnof | 187/9 E |
| 3,252,545 | 5/1966 | Quayle | 187/9 E |
| 3,344,890 | 10/1967 | Loef | 187/9 E |
| 3,394,778 | 7/1968 | Brinton | 187/9 E |
| 3,651,891 | 3/1972 | Pittaluga | 187/9 E |
| 3,774,726 | 11/1973 | Bredberg | 187/9 E |
| 3,819,013 | 6/1974 | Crum | 187/11 |
| 3,876,039 | 4/1975 | Bushnell, Jr. | 187/9 E |
| 3,957,137 | 5/1976 | Vermette | 187/11 |
| 4,015,686 | 4/1977 | Bushnell, Jr. | 182/148 |

FOREIGN PATENT DOCUMENTS

| | | | |
|---|---|---|---|
| 661754 | 3/1964 | Italy | 187/9 E |
| 786337 | 11/1957 | United Kingdom | 187/9 E |
| 2016409 | 9/1979 | United Kingdom | 187/9 E |

*Primary Examiner*—Reinaldo P. Machado
*Assistant Examiner*—Alvin Chin-Shue
*Attorney, Agent, or Firm*—Seed and Berry

[57] ABSTRACT

A multistage portable lift has an arm projecting rearwardly from one of the movable lift stages and a reeving system including a cable transferring a downward counterbalancing force to the arm from a load at the front of the lift. In the preferred embodiment, the load support is caused to moved upwardly to the upper end of the top stage before the movable stages move relative to one another responsive to upward movement of the lowermost movable stage by an independent elevating means.

21 Claims, 12 Drawing Figures

FIG. 5
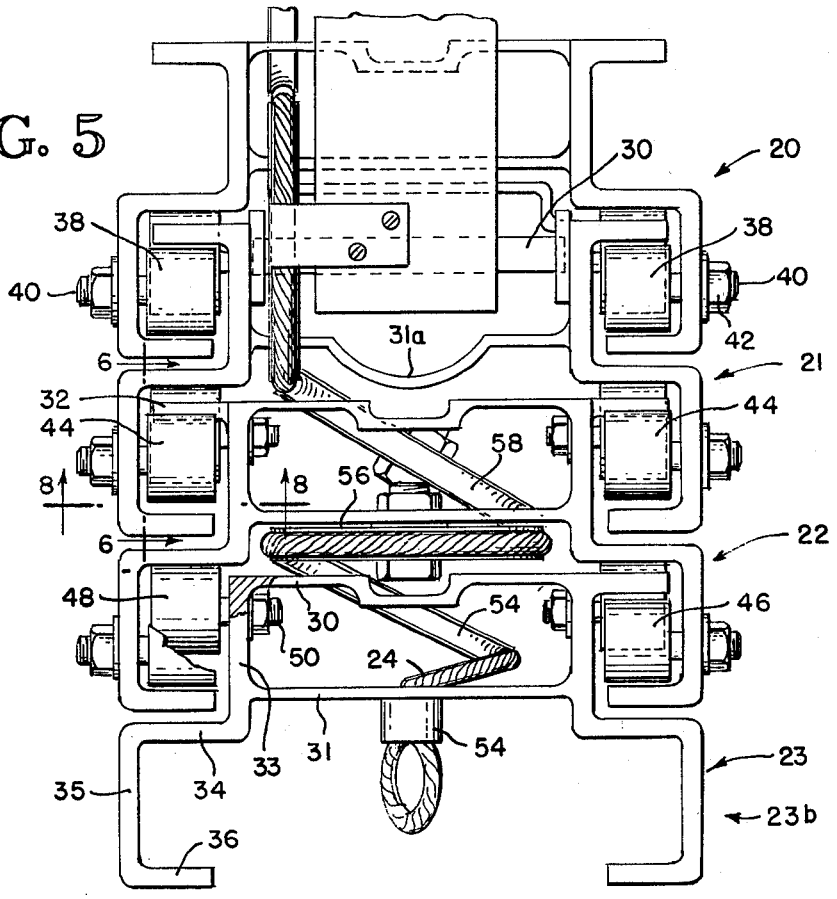
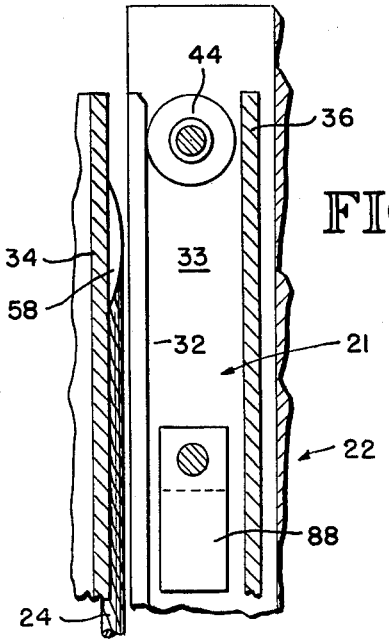
FIG. 7
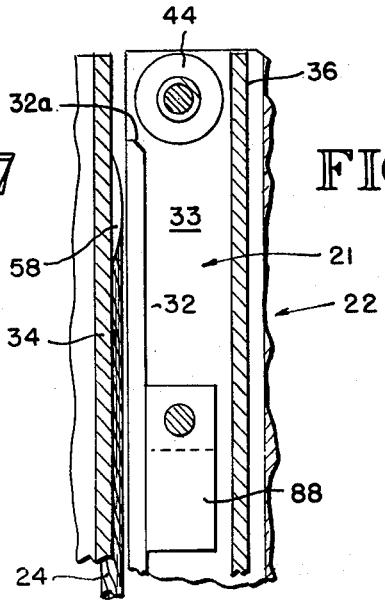
FIG. 6

LIFT

DESCRIPTION

1. Technical Field

The present invention relates to a portable, multistage lift which incorporates a reeving system for at least part of the elevating system to cause the lift stages to move relative to one another.

2. Background Art

More specifically, the present invention is an improvement over my prior U.S. Pat. No. 4,015,686, issued Apr. 5, 1977. As noted in my prior patent, for construction and repair service work, it is often necessary that personnel or relatively heavy materials or equipment be raised to an elevated position on a work platform or load-carrying forks. If the lift has a single mast and the load is supported so that its center of gravity is offset from the lift axis, there is created a moment tending to tip over the lift. If the lift is to be of lightweight construction for ease of transport and it is to have the ability to raise to elevations in the range of 30–40 feet, it is difficult to maintain stability even if outriggers are provided for the base of the unit. Stability is, of course, particularly important if the lift is being used to raise personnel to an elevated working level. With such a lift, it is also desirable to not have to use outriggers on the base which extend laterally because this limits how close the lift can be located with respect to the wall of a building or other structure.

It is also preferred to have such a lift operate in a manner whereby the work platform moves to the top of the upper mast section before the various mast sections move relative to one another. Otherwise, the upper stage of the lift may come in contact with the overhead structure before the working platform has reached the desired height. It is also preferred that the elevation of the working platform, after it has been elevated to substantially the desired height, be able to be adjusted.

DISCLOSURE OF INVENTION

The present invention utilizes a mast structure similar to that shown in my prior patent, U.S. Pat. No. 4,015,686, but incorporates an improved reeving system and use of a counterbalance arm which projects from the top of one of the movable mast sections in a direction opposite that occupied by a load-carrying unit. Load is transferred through the reeving system from the working platform to the outer end of the arm, and this creates a counterbalancing moment to offset that created by the load. The system depends upon the lowest of the movable mast sections being powered upwardly independently of the reeving system by a suitable elevating means such as a hydraulic or pneumatic cylinder, a jack, or a lifting cable operated by a stationary winch. A rechargeable battery pack may be provided on the base of the lift to power the elevating means.

Several embodiments of the invention are disclosed. In the preferred embodiment, the counterbalance arm is mounted on the lowermost movable mast section and the reeving system incorporates a single cable for transferring a downward counterbalancing force to the arm and for causing the movable mast sections(s) above the lowermost movable mast section to raise responsive to raising of the lowermost movable mast section by an independent elevating means.

In other embodiments, the counterbalance arm is mounted on the top mast section and the reeving system incorporates more than one cable, namely, the same number of cables as movable mast sections. One of the cables transfers the downward counterbalancing force to the arm. The other cable(s) is(are) used to cause the movable mast section(s) to move upwardly to the desired extent responsive to raising of the lowermost movable mast section by an independent elevating means.

BRIEF DESCRIPTION OF THE DRAWINGS

In the accompanying drawings:

FIG. 5 is a detailed transverse sectional view of the mast when in lowered position;

FIGS. 6 and 7 are detailed sectional views taken as indicated in line 6—6 of FIG. 5 and showing the manner in which the top mast section is retarded against movement relative to the next mast section while the load-carrying unit is being raised relative to the top mast section;

BEST MODE FOR CARRYING OUT THE INVENTION

Figure 1:
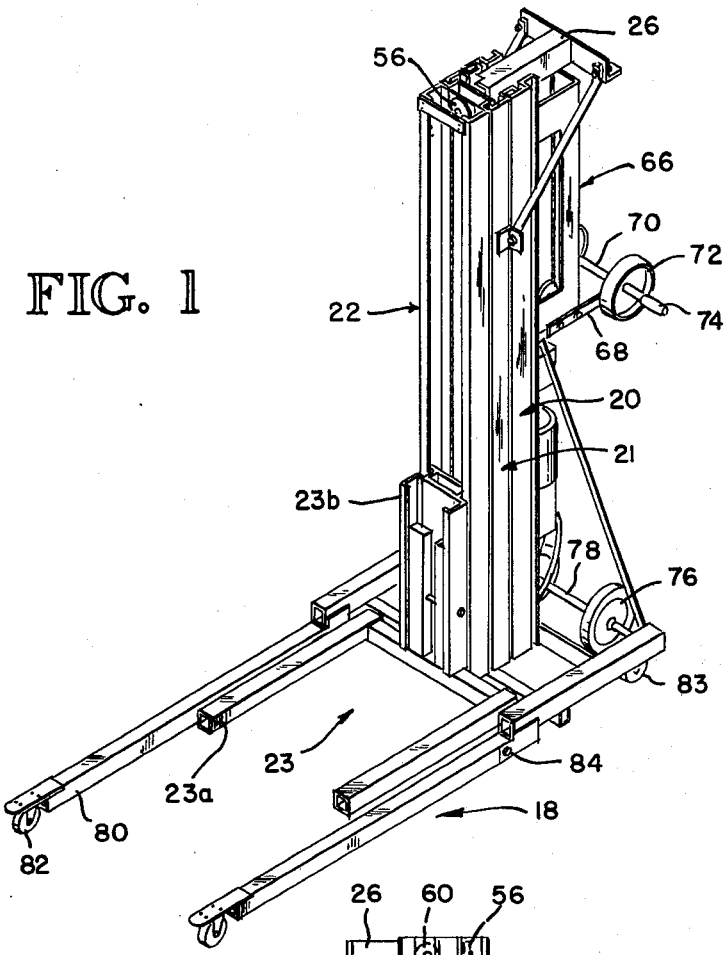
FIG. 1 is a front perspective view of a lift embodying the present invention.

For purposes of example, the invention is disclosed in FIGS. 1–7 of the drawings as applied to a lift having three telescopic mast stages or sections, namely, a stationary base stage 20 mounted on a base 18, an intermediate stage 21, and a top stage 22. A load support unit 23 is slide mounted at the rear of the top stage 22 and is interconnected by a cable 24 on a reeving system with a forwardly projecting counterbalance arm 26 mounted at the top of the intermediate stage 21. The intermediate stage is extended and retracted by action of a double-acting hydraulic cylinder unit 28 or other suitable elevating means. The unit 28 has its cylinder seated on the base assembly 18 and housed in the base stage 20, and has its piston rod **28*a* connected at its upper end to a cross-shaft 30 (FIG. 5) mounted at the upper end of the intermediate stage. As will be explained in detail later, raising of the intermediate stage by the unit 28 responsively causes raising of the load support unit 23 to the upper end of the top stage 22** and raising of the top stage relative to the intermediate stage by way of a reeving system.

The load support unit 23 has a pair of forks 23*a* projecting forwardly from a cross-member at the lower end of a slide section 23*b*. This slide section and the three mast sections 20–22 may be aluminum extrusions having basically the same cross-section as shown in FIG. 5. The extrusion has reversed symmetrical portions at both lateral sides which are connected by a rear web 30 and a center web 31. In the case of the intermediate mast section 21, the center web is formed with a central forwardly arched portion 31*a* to accommodate the front of the hydraulic cylinder 28. The side portions of the extrusion each have an outwardly projecting rear track flange 32 continuing from the rear web 30, a closure portion 33 forming a box with the webs 30–31, and a front inwardly facing channel formed by a rearwardly facing central flange 34, an outer flange 35, and a front track flange 36. To guide the intermediate stage 21, the base stage 20 is provided with a pair of aligned rollers 38 journaled on stub shafts 40 extending through the outer flanges 35 of the base stage 20 to a position between the rear track flanges 32 of the intermediate stage 21 and the front track flanges of the base stage 20. Nuts 42 secure the shafts 40 in position. In like manner, a pair of aligned rollers 44 is mounted on the intermediate stage 21 for engagement by the rear track flanges 32 of the top stage 22, and a pair of aligned rollers 46 is mounted on the top stage 22 for engagement by the rear track flanges of the load support unit 23. To further assist in guiding the load support unit 23 along the top stage 22, an additional set of rollers 48 is provided. This set is mounted by shafts 50 projecting outwardly from the closure portions 33 of the slide section 23*b* near the lower end thereof so as to engage the front face of the central flanges 34 of the top stage 22 through cutouts in the bottom of the rear track flanges 32 of the slide section 23*b*. The lower end portions of the top stage 22 and intermediate stage 21 are also preferably fitted with a second set of guide rollers in the same manner as the lower rollers 48 on the load-carrying unit 23.

Figure 4:
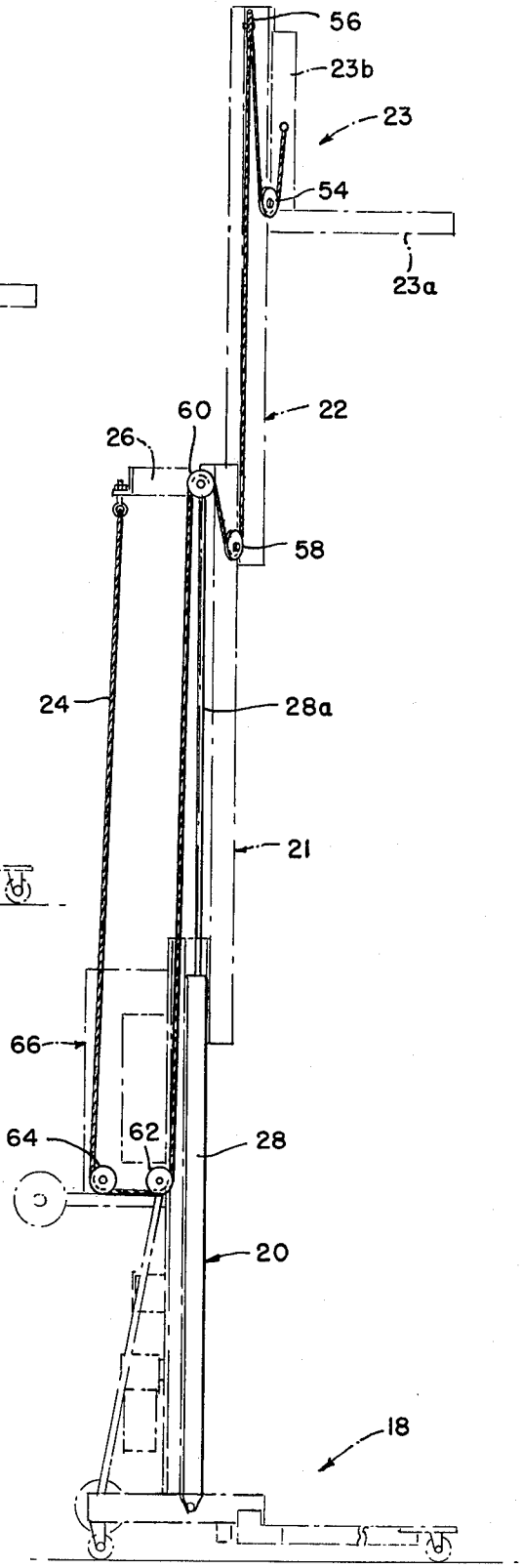
FIG. 4 is a side elevational view of the lift at its maximum raised elevation.

The cable 24 in the reeving system is dead-ended at its rear end at 52 on the arm 26 and at its front end near diagonal sheave 54 on the load-carrying unit 23. As best seen in FIG. 4, the cable 24 extends downwardly from its forward end around a diagonal sheave 54 at the lower end of the slide section 23*b*, upwardly over a sheave 56 at the upper end of the top stage 22, downwardly around a diagonal sheave 58 at the lower end or the top stage 22, upwardly over a sheave 60 at the top of the intermediate stage 21, downwardly around sheaves 62 and 64, and upwardly to the arm 26. The sheaves 62 and 64 are journaled near the bottom of a lower strut assembly 66 extending rearwardly from the back of the bottom stage 20. This strut assembly 66 serves as a cable guard and helps support a pair of rearwardly projecting struts 68 for an axle 70. Transport wheels 72 are mounted on the axle 70, and outwardly of the wheels 72 the axle 70 has a pair of handles 74. Another set of transport wheels 76 is mounted slightly above ground level on an axle 78 aft of the rear of the base assembly 18.

The base assembly 18 has a pair of front reches 80 latched in position and having casters 82 at their forward ends to complement rear casters 83 provided with locks. These reaches 80 are adapted to be unlatched and swung upwardly at 84 for compact storage. When the forks 23*a* are in their lowered position, they are situated between the reaches 80, as shown in FIG. 1. The forks 23*a* may be made to have an alternate position located at the top of the slide section 23*b*, as disclosed in my prior U.S. Pat. No. 3,876,039, so that a relatively short load resting on the forks will always extend above the top of the mast when the load-carrying unit 23 is at its upper limit of travel realtive to the top stage of the mast.

With the described arrangement, the entire lift assembly can be rocked back onto the wheels 76 while gripping the handles 74 and easily wheeled about a jobsite. Both sets of wheels 72, 76 can be used to support and roll the lift unit on a truck bed, for example, being used to move the unit to another jobsite.

Figure 8:
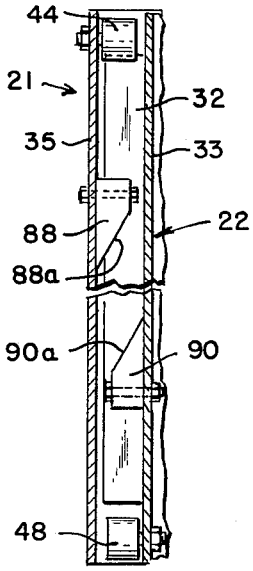
FIG. 8 is another detailed view taken as indicated in line 8—8 of FIG. 5 and shows the location of the stops for limiting upward movement of the various mast sections relative to one another.

A pair of stop shoes 88 is mounted on the outside faces of the portions 33 near the top of the three mast sections 20–22 for engagement by stops 90 mounted, respectively, near the lower ends of section 23*b* of the load-carrying unit, the top mast section 22 and the intermediate mast section 21. These stops 88, 90 preferably have cooperating bevel faces 80*a*, 90*a* (FIG. 8) to assist in rigidifying the mast when fully extended. Directing attention to FIGS. 6–7, it will be noted that the stops 88 are spaced forwardly of the rear track flange 32 of the next forward section. It will also be noted that the flanges 32 have been cut back at their upper end approximately the diameter of the rollers 44 to provide a cam 32*a*. This is done so that top mast section 22 can rock forward slightly under load to the position shown in FIG. 6 while the mast section 22 is at the same height as the intermediate section 21. When in such position, the forward top section 22 cannot move upwardly relative to the intermediate section 21 without the cam 32*a* of the top section 22 coming into engagement with the underside of the top roller 44 of the intermediate mast section 21. As will be further discussed, when the cam 32*a* does engage the underside of the roller 44, relative motion between the top and intermediate mast sections is retarded and cannot continue until the top mast section swings rearwardly sufficiently to permit the cam 32*a* to ride over the back of the roller 44, as shown in FIG. 7. This retarding action makes certain that the load-carrying unit 23 will move to the top of the top mast section 22 before the latter moves upwardly relative to the intermediate mast section 21.

Figure 2:
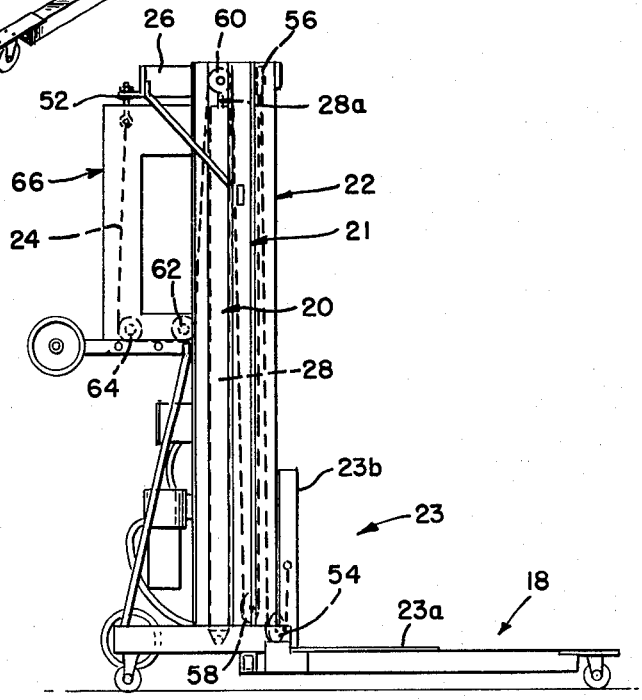
FIG. 2 is a side elevational view of the lift shown with the load-carrying unit at the ground level.
Figure 3:
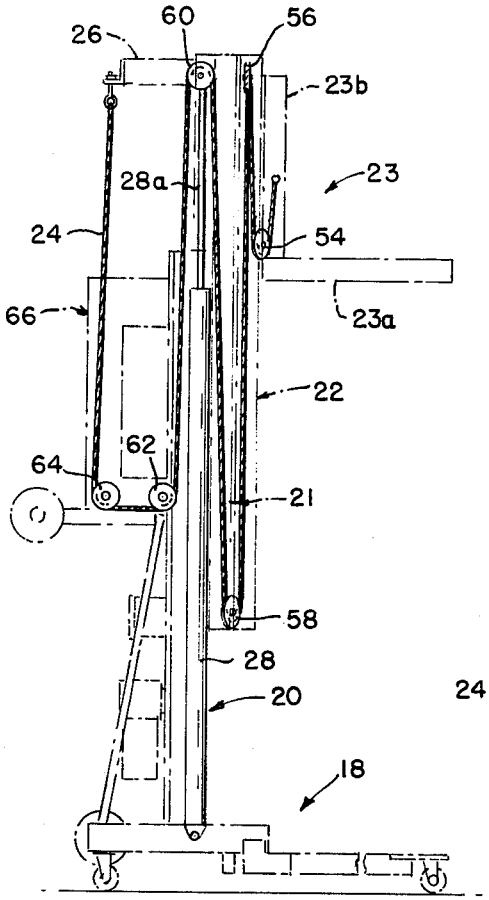
FIG. 3 is a side elevational view of the lift in partly raised position, namely, at the level at which the load-carrying unit has reached its upper limit of travel relative to the top section of the mast.

Attention is now directed to FIGS. 2–4, showing the various stages of the load-carrying units and mast sections. Starting with load-carrying unit 23 at its lowermost position, as shown in FIG. 2, when the hydraulic cylinder 28 is activated, thereby causing the intermediate mast section to move upwardly relative to the base section 20, the portion of the cable 24 between the load-carrying unit 23 and the top of the intermediate mast section 21 is shortened an amount equal to twice the extension of the hydraulic cylinder. This means that the load-carrying unit 23 will initially move upwardly relative to the base section 20 a distance equal to three times the amount of extension of the hydraulic cylinder. Hence, when the mast section has moved upwardly one-third of its total possible extension, the load-carrying unit will have reached the top of the top mast section 22. In this regard, a load on the load-carrying unit will have caused the top mast section 22 to rock slightly forward relative to the intermediate mast section 21, as previously discussed with respect to FIGS. 6–7, thereby preventing the top mast section 22 from moving upwardly relative to the intermediate mast section 21 while the load-carrying unit 23 is moving upwardly relative to the top mast section 22. Accordingly, the mast sections and the load-carrying unit should be in the position shown in FIG. 3 when the load-carrying unit 23 has reached the top of the top mast section 22. Further extension of the cylinder 28, and the resulting shortening of the cable portion between the mast sections 22 and 21, cause the top section 22 to move upwardly relative to the base section 20 at a rate three times the cylinder extension, and this results in the upper mast section 22 becoming fully extended relative to the intermediate mast section 21 when the latter has moved upwardly two-thirds of its potential movement relative to the base section 20. Further extention of the hydraulic cylinder 28 then completes the full extension of the mast section shown in FIG. 4 as the intermediate section 21 is moved to the top of the base section 20.

Figure 12:
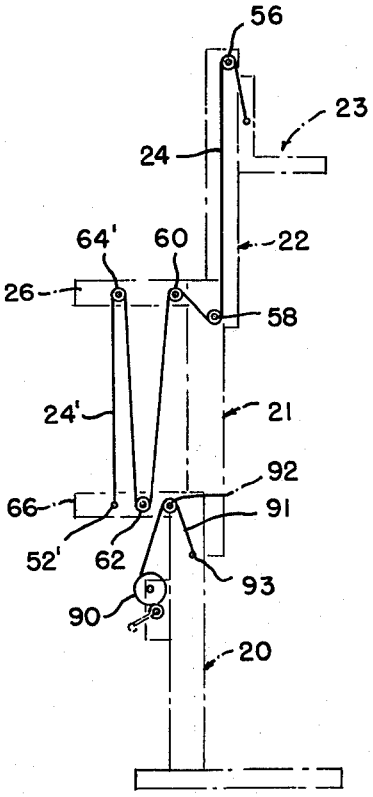
FIG. 12 is a side elevational view illustrating a unit of the type shown in FIG. 1, but modified to replace the lift cylinder with another lifting means and with the reeving system modified to speed raising and lowering of the working platform relative to the top stage of the lift.

Directing attention to FIG. 12, there is illustrated a modified reeving system in which the cable 24 has an additional pass 24' between the arm 26 and strut 66 about a sheave 64' on the arm and dead-ends at 52' on the strut 66. The result of this modification is that the load-carrying unit 23 moves upwardly responsive to extension of the cylinder unit 28 acting on the intermediate mast section 22, at a faster rate, and namely, four times the extension of the cylinder unit 28 rather than three times. Similarly, the top stage 22 then moves upwardly relative to the intermediate stage at four times the amount of further extension of the cylinder unit. As a result, the load-carrying unit is at the upper end of the top mast section 22 when the cylinder unit 28 has one-fourth of its total extension, and the top section 22 reaches its upper limit of travel relative to the intermediate section 21 when the cylinder unit 28 has one-half of its total extension. FIG. 12 also illustrates an alternative elevating means to the cylinder unit 28, and namely, a winch 90 operating on a cable 91 extending over a sheave 92 at the upper end of the base stage 20 and downwardly to a connection 93 to the lower end of the intermediate mast section 21.

Figure 11:
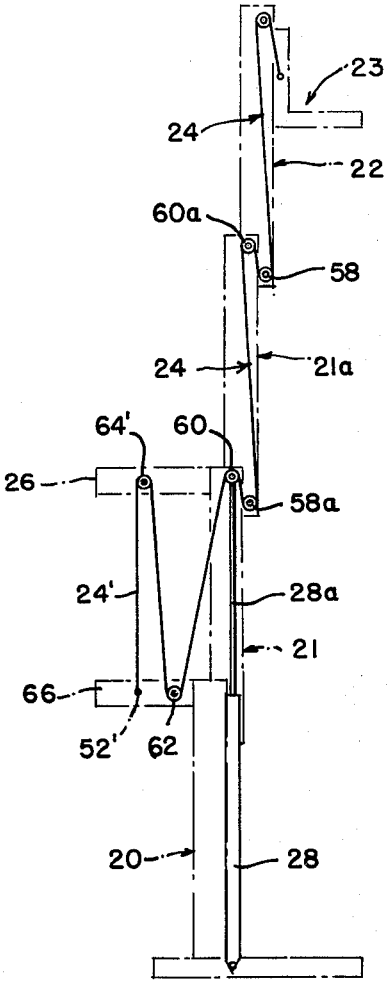
FIG. 11 is a side elevational view illustrating a unit of the type shown in FIG. 1, but with an additional intermediate mast section.

Directing attention to FIG. 11, there is illustrated a mast with an additional intermediate section 21*a*. This section 21*a* has the same retarding arrangement (FIGS. 6–7) with the top mast section 22 as previously described. The reeving system has been expanded to include sheaves 58*a*, 60*a* at the lower end and upper end, respectively, of the additional intermediate mast section 21*a*. It will also be noted that the reeving system also has been modified as in FIG. 12 to add another pass 24' between the arm 26 and strut 66 and thereby give three passes. This is the minimum number of passes for three movable mast stages (one pass per movable mast stage), just as at least two passes were necessary for two movable mast sections, as shown in FIGS. 2–4, to achieve the desired total result of the present invention.

In the embodiment of FIG. 11, when the cylinder unit 28 extends one-fourth of its total extension, the load carrying unit 23 reaches the top of the top mast section 22, at which point all three of the mast sections 21, 21*a* and 22 are at the same extended height of one-fourth of the total extension of the cylinder unit 28. The top mast section 22 then begins to move upwardly relative to the upper intermediate mast section 21*a* at a rate of four times the additional extention of the cylinder unit, so that it reaches the upper end of its travel relative to the upper intermediate section 21*a* when the cylinder unit is halfway extended. Similarly, the upper intermediate section 21*a* then reaches the upper end of its travel relative to the lower intermediate section 21 when the cylinder unit 28 has extended three-fourths of its total extension.

Figure 9:
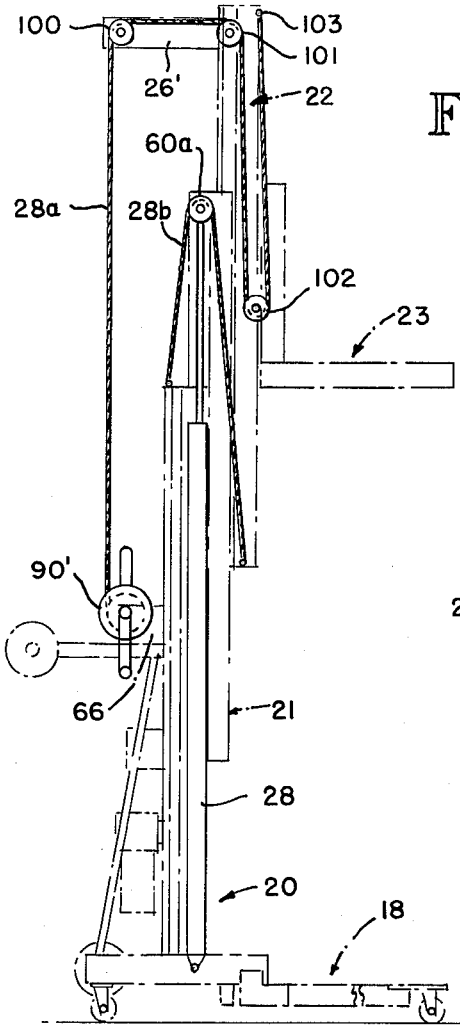
FIG. 9 is an elevational view of a modified system with the counterbalance arm on the top mast section.
Figure 10:
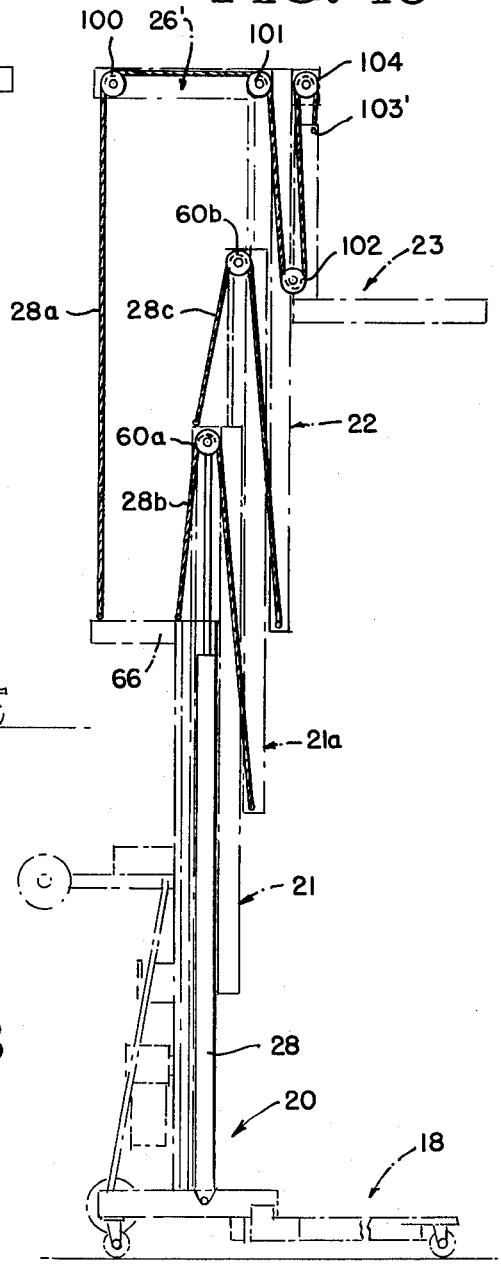
FIG. 10 is a side elevational view of a modified system like that in FIG. 9, but with an additional mast stage.

FIGS. 9 and 10 show two further embodiments in which the counterbalance arm is moved to the top mast section 22 and designated 26'. In the FIG. 9 embodiment, the reeving system involves a cable 28*a* extending from a winch 90' on its strut 66 upwardly to the arm 26' and includes a second cable 28*b* extending from the upper end of the base stage 20 over a sheave 60*a* at the top of the intermediate stage 21 and then downwardly to a connection at the lower end of the top stage 22. It will be apparent that the second cable 28*b* causes the top stage 22 to move upwardly relative to the intermediate stage 21 responsive to extension of the cylinder unit 28 and at the same rate. Returning to the other cable 28*a*, it passes around a sheave 100 at the outer end of the arm 26', travels forwardly over a sheave 101 at the upper end of the top stage 22, goes downwardly around a sheave 102 on the load-carrying unit 23, and then passes upwardly to an anchor point 103 at the upper end of the top stage 22. When the cylinder unit is in its fully retracted position and the load-carrying unit 23 is at the bottom of the mast with the winch 90' locked, extension of the cylinder unit results in upward movement of the load-carrying unit 23 relative to the top stage 22 as well as upward movement of the top stage 22 relative to the intermediate stage 21. As the length of cable between the arm 26' and winch 90' increases responsive to upward travel of the top stage 22, the two passes of the cable from the sheave 101 and dead-end 103 to the sheave 102 on the load-carrying unit 23 cause the latter to move upwardly relative to the top stage the same distance as the extension of the cylinder unit 28. Hence, under these conditions, the load-carrying unit 23 will reach the top of the mast at the same time as the mast becomes fully extended. However, when the mast is not fully extended, the winch 90' can be operated at will to move the load-carrying unit to its upper limit of travel relative to the top mast stage 22 or to otherwise adjust the position of the load-carrying unit.

The FIG. 10 embodiment, like that of FIG. 11, has an additional intermediate mast section 21*a*. The reeving system includes a third cable 28*c* passing upwardly from the upper end of the lower intermediate section 21 over a sheave 60*b* at the top of the upper intermediate section 21*a* and then downwardly to a connection at the lower end of the top stage 22. This third cable 28*c* causes the top stage 22 to move upwardly relative to the upper intermediate section 21*a* at the same rate as the cable 28*b* causes the upper intermediate section 21*a* to move upwardly relative to the lower intermediate section 21 responsive to extension of the cylinder unit 28. It will be noted that an additional sheave 104 has been added at the upper end of the top stage 22 for the cable 28*a* and that the dead-end at the forward end of this cable has been moved to 103' on the load-carrying unit 23. The result is to increase the number of passes of the cable 28*a* between the top stage 22 and the load-carrying unit 23 from two (as in the FIG. 9 embodiment) to three in correspondence with the number of movable mast stages so that the load-carrying unit will move from base level to the upper end of the mast at the same time as the mast becomes fully extended responsive to extension of the cylinder unit 28 or other elevating means. A winch can also be provided on the strut 66 for the cable 28*a* for adjustment of the load-carrying unit 23 as previously described with respect to the embodiment of FIG. 9.

In all of the described embodiments, a downward force is exerted on a counterbalance arm by a cable connected to the load-carrying unit. This force acts rearwardly of the mast on a sufficient moment arm to counterbalance the moment created at the front of the mast by the load. Hence, the mast is greatly stabilized.

The described embodiments of this invention may have further variations which will be apparent to those skilled in the art. Accordingly, this invention is not limited to the specific embodiments described unless required by the nature of the prior art or the appended claims.

I claim:

1. A lift comprising:

a multistage mast having a stationary base stage and movable stages, including a top stage, said mast having a front and a back;

a load support guided up and down at the front of the top stage;

elevating means for raising and lowering the lowermost movable stage relative to the base stage;

a counterbalance arm projecting backwardly from one of the movable stages;

reeving means operatively associated with each of the mast stages, the load support, and the outer end of said arm, for raising and lowering the load support relative to the top stage and for raising and lowering each movable stage located above the lowermost movable stage relative to one another and relative to the base stage integrally and as a unit, responsive to raising and lowering of the lowermost movable stage by the elevating means, said reeving system including a cable arranged to be continuously tensioned by a load on the load support and to apply said tension as a counterbalancing force pulling downwardly on said arm rearwardly of said elevating means and base stage to stabilize the lift to the load.

2. A lift according to claim 1 in which said arm is mounted at the upper end of the lowermost movable stage.

3. A lift according to claim 2 in which said cable has at least as many passes between the arm and the base stage as there are stages above the lowermost movable stage.

4. A lift according to claim 1 in which said arm is mounted at the upper end of the top stage.

5. A lift according to claim 4 in which said cable has at least as many passes between the top of the top stage and the load support as there are movable stages.

6. A lift according to claim 1 in which said lift has only one stage between the top movable stage and the base stage, and said cable passes downwardly from the arm to the base stage, upwardly to the upper end of the lowermost movable stage, downwardly to the lower end of the top stage, upwardly to the upper end of the top stage, and downwardly to the load support, the passes of the cable being in the aforesaid order between the arm and the load support, and the reeving means including sheaves at the transitions between the cable passes.

7. A lift according to claim 1 in which said lift has two stages between the top movable stage and the base stage, and said cable passes upwardly from the base stage to said arm, downwardly to the base stage, upwardly to the upper end of the lowermost movable stage, downwardly to the lower end of the next higher movable stage, upwardly to the upper end of said next stage, downwardly to the lower end of the top stage, upwardly to the upper end of the top stage, and downwardly to the load support, the passes of the cable being in the aforesaid order between the arm and the load support, and the reeving means including sheaves at the transitions between the cable passes.

8. A lift according to claim 6 in which said cable makes two passes between said arm and the base stage.

9. A lift according to claim 1 in which said base stage includes a cable support projecting rearwardly beneath said arm, and said cable passes between said arm and said cable support in a generally vertical path.

10. A lift according to claim 6 in which said base stage includes a cable support projecting rearwardly beneath said arm, and said cable passes between said arm and said cable support.

11. A lift according to claim 9 in which said cable is anchored on said cable support.

12. A lift according to claim 9 in which said cable is anchored on said cable support, passes upwardly from the cable support to said arm, forwardly to the upper end of the top stage, downwardly to the load support, and upwardly to the upper end of the top stage.

13. A lift according to claim 12 in which the cable takes another pass downwardly from the upper end of the top stage to the load support.

14. A lift according to claim 1 in which said reeving means includes a second cable passing from the base stage upwardly to the upper end of the lowermost movable stage, and then downwardly to the lower end of the next higher stage.

15. A lift according to claim 14 in which said arm is on the top stage and the first-mentioned cable passes upwardly from the base stage to said arm, forwardly to the upper end of the top stage, and downwardly to the load support.

16. A lift according to claim 14 in which said mast has three movable sections and the reeving means includes a third cable passing from the lowermost movable stage upwardly to the upper end of the next higher stage and then downwardly to the lower end of the top stage.

17. A lift comprising:

a multistage mast including a stationary base stage, a top stage, and at least one intermediate stage between the top and base stages, said mast having a front and a back;

a load support arranged to move up and down at the front of the top stage;

elevating means connected to the lowermost intermediate stage for raising and lowering it relative to the base stage;

reeving means interconnecting the mast stages so that each stage above the lowermost intermediate stage raises and lowers relative to the next lower section the same amount as the lowermost intermediate section is raised and lowered relative to the base section;

an arm mounted at the upper end of the lowermost intermediate section and projecting backwardly; and a reeving system including a cable passing from said arm to said load support via all of the mast sections for moving said load support up and down relative to said top section and for moving the mat sections, other than the base section, relative to one another and relative to the base section responsive to operation of the elevating means, said reeving system applyilng a downward counterbalancing force to said arm rearwardly of said elevating means.

18. A lift according to claim 17 in which there is only one intermediate mast stage and said cable passes from said arm downwardly to the back of said base stage on its way to said load support, whereby the tension in said cable caused by a load applied to the load support exerts the counterbalancing force.

19. A lift according to claim 18 further comprising retarding means, independent of the reeving system, and operatively associated with the top stage and intermediate mast stage, for keeping the top stage from moving upwardly relative to the intermediate mast stage until the load support has reached its upper limit of travel relative to the top stage, the load support raising in response to operation of said elevating means.

20. A lift according to claim 17 in which the uppermost intermediate mast stage has an upper guide roller arranged so that an upper end portion of the top mast stage can move forwardly beneath a rear portion of said roller responsive to load on said load support and prevent said top mast stage from moving upwardly relative to the uppermost intermediate mast stage until said load support has reached its upper limit of travel relative to the top mast stage responsive to operation of said elevating means, whereupon the reeving system is adapted to move the top mast stage rearwardly and cause it to slide upwardly against the back of the guide roller.

21. A lift according to claim 20 in which a stop is mounted on the uppermost intermediate mast stage and is arranged to restrict forward movement of the upper portion of the top mast stage relative to said guide roller so that said upper end portion of the top mast stage cannot move forwardly beneath said roller beyond the rear half of the roller.

* * * * *

UNITED STATES PATENT AND TRADEMARK OFFICE

CERTIFICATE OF CORRECTION

PATENT NO. : 4,458,785

DATED : July 10, 1984

INVENTOR(S) : Sherman W. Bushnell, Jr.

It is certified that error appears in the above—identified patent and that said Letters Patent is hereby corrected as shown below:

Claim 17, line 23, change "mat" to --mast--;

Claim 17, line 27, change "applyilng" to --applying--.

Signed and Sealed this

*Nineteenth* Day of *March 1985*

[SEAL]

*Attest:*

DONALD J. QUIGG

*Attesting Officer* *Acting Commissioner of Patents and Trademarks*